United States Patent [19]

Dolcater

[11] Patent Number: 4,733,679

[45] Date of Patent: Mar. 29, 1988

[54] PAINT ROLLER COVER CLEANER

[76] Inventor: John S. Dolcater, 5421 SW. 94th Ave., Cooper City, Fla. 33328

[21] Appl. No.: 932,609

[22] Filed: Nov. 20, 1986

[51] Int. Cl.[4] ..... B08B 3/02

[52] U.S. Cl. ..... 134/138; 134/165; 68/213

[58] Field of Search ..... 134/138, 139, 141, 165; 68/213

[56] References Cited

U.S. PATENT DOCUMENTS

| | | | |
|---|---|---|---|
| 2,725,065 | 11/1955 | Wilsing | 68/213 X |
| 2,831,488 | 4/1958 | Anderson | 68/213 UX |
| 2,881,776 | 4/1959 | Wrage | 68/213 X |
| 3,075,534 | 1/1963 | Habostad | 68/213 X |
| 3,428,060 | 2/1969 | Spivey | 134/138 X |
| 3,577,280 | 5/1971 | George | 134/138 |
| 3,688,785 | 9/1972 | Stevens et al. | 134/138 |
| 3,873,364 | 3/1975 | Smith | 134/138 |
| 3,886,960 | 6/1975 | Krueger | 134/138 |
| 3,897,797 | 8/1975 | Wright et al. | 134/113 |
| 4,061,153 | 12/1977 | Donerty | 134/138 |
| 4,130,124 | 12/1978 | Sherwin | 134/138 |
| 4,294,272 | 10/1981 | Klaiber | 134/138 |
| 4,377,175 | 3/1983 | Fritz | 134/138 |

FOREIGN PATENT DOCUMENTS

| | | | |
|---|---|---|---|
| 2138659 | 2/1973 | Fed. Rep. of Germany | 134/138 |

*Primary Examiner*—Harvey C. Hornsby
*Assistant Examiner*—Frankie L. Stinson
*Attorney, Agent, or Firm*—Oltman and Flynn

[57] ABSTRACT

An apparatus for cleaning a paint roller cover removed from its handle. The apparatus has a cylindrical housing with a transverse end wall at one end carrying a tubular bushing and an opening at the opposite end. A shaft is snugly but slidably received in the end wall bushing and it extends longitudinally inside the housing and terminates short of the housing's end opening. A support for a roller cover is rotatably mounted on the shaft. This support can be slidably assembled frictionally to a paint roller cover. The asssembled paint roller cover, support and shaft can be inserted and removed as a unit through the end opening of the housing. A water spray tube inside the housing sprays water onto the roller cover on the support and shaft.

5 Claims, 4 Drawing Figures

PAINT ROLLER COVER CLEANER

SUMMARY OF THE INVENTION

This invention relates to an apparatus for cleaning a paint roller cover removed from its handle.

Typical paint roller assemblies now in use comprise a handle with a hand grip and a rigid metal rod extending from the hand grip and having an elongated, straight, outer end segment, a roller cover support rotatably mounted on the outer end segment of the handle rod, and a roller cover with a cylindrical core frictionally received on the roller cover support and slidably removable from it by a deliberate manual effort.

The present invention is directed to a novel apparatus for cleaning the roller cover after it has been removed from the rest of the roller assembly.

Preferably, the present invention comprises a cylindrical housing with a transverse end wall at one end and a wide opening at the opposite end. An elongated rigid shaft rotatably supports a roller cover support like the one in a typical paint roller. The shaft and support assembly, with a paint roller cover on the support, is insertable and removable through the end opening of the housing. The housing end wall carries a bushing which snugly but slidably receives the inner end of the shaft to support the shaft in cantilever fashion inside the housing. A transverse collar on the shaft engages the bushing to define the longitudinal position of the shaft and roller cover support assembly in the housing. A water spray tube along the inside of the housing sprays water tangentially onto the roller cover to cause it and the support to rotate on the shaft.

A principal object of this invention is to provide a novel paint roller cleaner for cleaning a paint roller cover which has been removed from the rest of the paint roller assembly.

Further objects and advantages of this invention will be apparent from the following detailed description of a presently preferred embodiment which is illustrated schematically in the accompanying drawings.

Figures 1, 2, 3, 4:
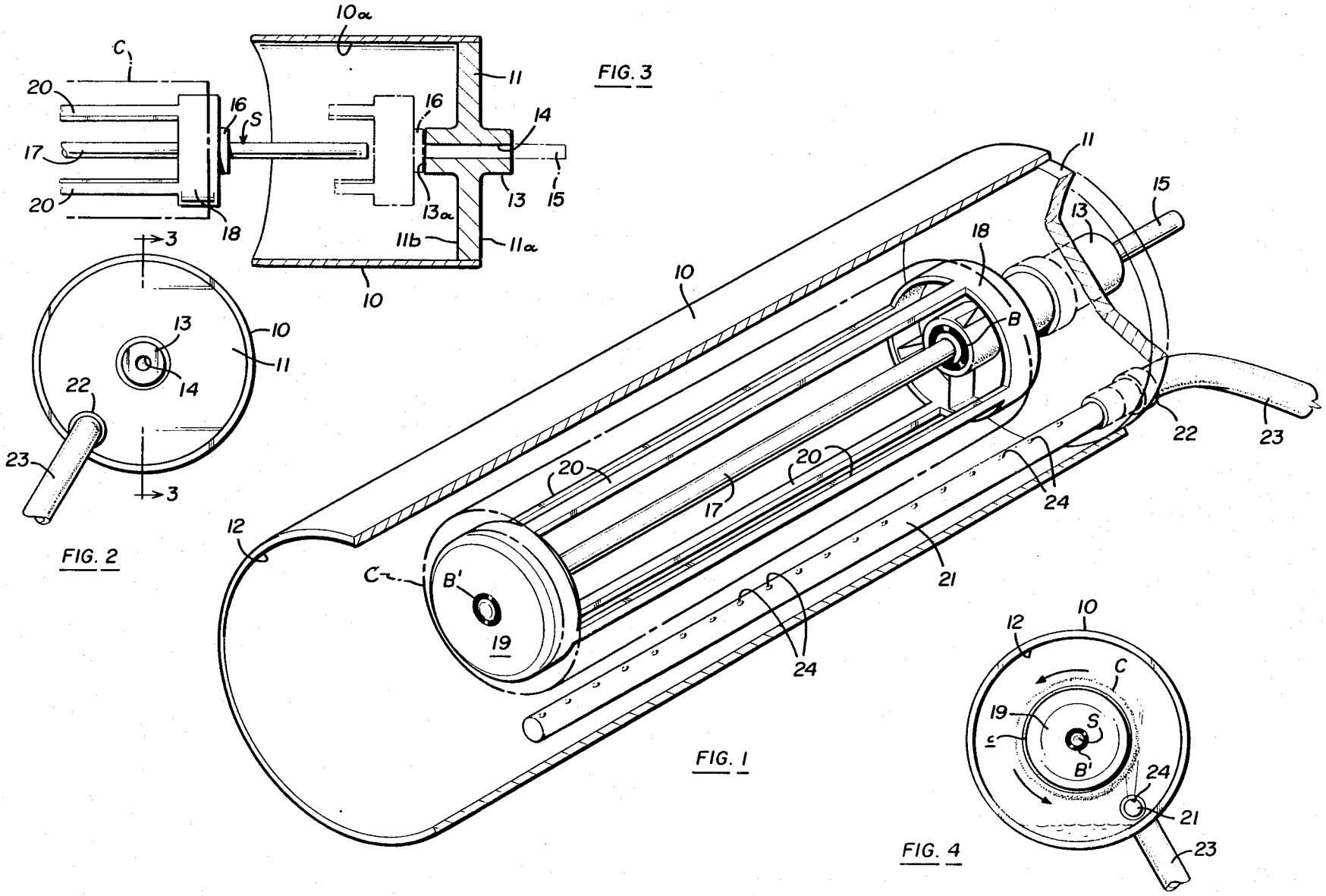
FIG. 1 is a perspective view of the present paint roller cleaner with parts broken away for clarity.
FIG. 2 is an end elevation taken from the right end of FIG. 1.
FIG. 3 is a fragmentary longitudinal section taken along the line 3—3 in FIG. 2, showing the assembled position of the parts in phantom and the disassembled position in full lines.
FIG. 4 is an end elevation taken from the left end of FIG. 1.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

As shown in FIG. 1, the present apparatus has an elongated cylindrical housing 10 which has a transverse end wall 11 at its right end and is completely open, as shown at 12, at its left end. As shown in FIG. 2, the end wall 11 is a separately formed one-piece body having a generally cylindrical bushing 13 at the center which projects beyond both the outer end face 11*a* and the inner end face 11*b* of the end wall. This bushing segment presents a cylindrical bore 14.

An elongated rigid shaft S of circular cross-section has an inner end segment 15 which is snugly but slidably insertable into and removable from the bore 14 in the end wall bushing 13. A transverse collar 16 on this shaft is engageable with the inner end face 13*a* of the end wall bushing 13, as shown in phantom in FIG. 3, to limit the insertion of shaft S into the bushing and to define the position of the shaft longitudinally of the housing. To the left of the collar 16 in FIG. 3 the shaft S presents an elongated segment 17 which extends centrally along the inside of housing 10 and terminates short of the opening 12 in the left end of the housing.

A paint roller cover support of conventional design is rotatably mounted on the elongated segment 17 of shaft S. This roller cover support comprises opposite end segments 18 and 19 of cylindrical outline and several longitudinal segments 20 extending between and joined to the end segments 18 and 19. The longitudinal segments 20 are spaced apart circumferentially of the end segments. The end pieces 18 and 19 and the longitudinal pieces 20 of the roller cover support have a frictional sliding fit with the inside of the usual cylindrical core c (FIG. 4) of a paint roller cover C of conventional design. That is, a person can by deliberate effort slide the paint roller cover onto this roller cover support or remove it from the roller cover support but, once in place on the roller cover support, the roller cover is held frictionally against accidental displacement.

The collar 16 may be formed integral with the end segment 18 of the roller cover support, or it may be formed integral with the shaft S, or it maybe formed separately from both the roller cover support and the shaft and attached to one or the other of them.

The opposite end segments 18 and 19 of the roller cover support carry respective ant-friction bearings B and B′, such as ball bearings, which mount the roller cover support rotatably on the elongated segment 17 of the shaft S.

An elongated spray tube 21 extends along the inside of housing 10 parallel to shaft S and offset laterally from it. The housing end wall 11 carries a fitting 22 for connecting the right end of spray tube 21 to a water supply hose 23. The spray tube is closed at its left end in FIG. 1. It presents a plurality of water discharge openings or jets 24 at intervals along its length. As shown in FIG. 4, these water discharge openings are positioned to spray water more or less tangentially onto a roller cover C positioned on the roller cover support 18, 19, 20, so as to cause the roller cover and the support to rotate on shaft S.

In the use of this apparatus, as shown in full lines in FIG. 3, the unitary assembly of shaft S and roller cover support 18, 19, 20, may be removed from the housing for convenient assembly to the paint roller cover which is to be cleaned. Then this assembly is inserted through the end opening 12 into the housing 10, and the inner end segment 15 of shaft S is slid into the end wall bushing 13. The shaft S extends in cantilever fashion from this end wall along the central axis of housing 10 and it rotatably supports the roller cover support 18, 19, 20 and the roller cover C. When the water supply is turned on, the water sprays from the spray tube openings 24 wash paint from the roller cover and cause the roller cover and its support 18, 19, 20, to rotate on shaft S, so that paint is thrown off centrifugally from the roller cover and the entire circumference of the roller cover is cleaned quickly. The housing 10 may be tipped slightly from the horizontal so that the paint and water mixture runs out through the opening 12 in the left end of the housing.

After the roller cover has been adequately cleaned, the user reaches in through the housing opening 12 and grasps the roller cover to remove it, the roller cover support 18, 19, 20 and the shaft S as a unit from the housing, after which the user removes the roller cover C from the roller cover support 18, 19, 20, on which it had been frictionally mounted.

I claim:

1. A paint roller cleaner comprising:

an elongated hollow housing having an end wall at one end and an opening at the opposite end;

an elongated shaft removably mounted in said end wall and extending along the inside of said housing and terminating short of said opening, said shaft being slidably removable from said end wall and removable from said housing through said opening;

a support for a paint roller cover mounted on said shaft for rotation with respect to said shaft, said support having means for slidable insertion into and frictional engagement with a paint roller cover;

said housing, said shaft and said support being free of any obstruction to the insertion and removal of said shaft and said support with a paint roller cover thereon as a unit into and out of said housing through said opening toward and away from said end wall, and means inside said housing for spraying water onto a paint roller cover on said support.

2. A paint roller cleaner according to claim 1, wherein said end wall of the housing carries a tubular bushing which is elongated lengthwise of the housing and receives said shaft snugly but slidably.

3. A paint roller cleaner according to claim 2, wherein:

said bushing extends from said end wall into said housing;

and further comprising:

a transverse collar on said shaft at one end of said support for engagement with said bushing to limit the insertion of said shaft and said support into said housing and position said shaft and said support longitudinally within said housing.

4. A paint cleaner according to claim 3 wherein said spray means is an elongated tube extending longitudinally inside said housing from said end wall toward said opening and having openings spaced apart along its length for spraying water onto a paint roller cover on said shaft, said tube being spaced laterally from said shaft more than the combined radial thickness of said shaft and said support with a paint roller cover thereon, whereby to permit the insertion and removal of said shaft and said support with a paint roller cover thereon through said opening in the housing.

5. A paint roller cleaner comprising:

an elongated cylindrical housing having a transverse end wall at one end and an opening at the opposite end, said end wall presenting a tubular bushing which is elongated longitudinally of said housing and projects from said end wall into said housing;

an elongated shaft having an inner end segment snugly but slidably received in said bushing and an elongated segment extending longitudinally inside said housing away from said end wall and terminating short of said opening at the opposite end of the housing;

means providing a transverse collar on said shaft between said inner end segment and said elongated segment for engagement with said bushing to define the longitudinal position of the shaft within the housing;

a paint roller cover support having opposite end segments and longitudinal segments connecting said end segments, said end and longitudinal segments of said support being shaped to frictionally engage and support the core of a paint roller cover, and antifriction bearings on said end segments rotatably mounting said support on said elongated segment of said shaft;

said housing, said shaft and said support being free of any obstruction to the insertion and removal of said shaft and said support with a paint roller cover thereon as a unit into and out of said housing through said opening toward and away from said end wall;

and an elongated spray tube extending along the interior of said housing and offset laterally from said shaft substantially more than the combined radial thickness of said shaft and said support with a paint roller cover thereon, whereby to permit the insertion and removal of said shaft and said support with a paint roller cover thereon through said opening in the housing, said spray tube having water discharge openings at intervals along its length for spraying water onto a paint roller cover on said support;

said shaft and said support with a paint roller cover thereon being removable as a unit from inside said housing through said opening in said opposite end of the housing and being insertable longtitudinally into said housing through said opening to position said inner end segment of the shaft in said bushing on said end wall of the housing.

* * * * *